United States Patent [19]

Fuehrer

[11] Patent Number: 4,712,705

[45] Date of Patent: Dec. 15, 1987

[54] TAMPER INDICATING CAP SEAL FOR CONTAINER VALVES

[75] Inventor: Charles Fuehrer, Scarsdale, N.Y.

[73] Assignee: Stoffel Seals Corporation, Tuckahoe, N.Y.

[21] Appl. No.: 8,944

[22] Filed: Jan. 30, 1987

[51] Int. Cl.[4] ..... B65D 51/16

[52] U.S. Cl. ..... 220/270; 220/85 P; 215/254; 215/256; 222/182

[58] Field of Search ..... 220/85 P, 257, 270; 215/254, 256, 321, 336; 222/182, 153

[56] References Cited

U.S. PATENT DOCUMENTS

| | | | |
|---|---|---|---|
| 2,643,015 | 6/1953 | Soffer | 15/253 |
| 2,760,671 | 8/1956 | Parish, Jr. . | |
| 3,102,658 | 9/1963 | Rosen | 220/270 |
| 3,162,329 | 12/1964 | Gregory | 222/182 |
| 3,465,907 | 9/1969 | Dorn et al. | 215/256 |
| 3,474,930 | 10/1969 | Lerner | 222/270 |
| 3,592,351 | 7/1971 | Johnson, Jr. | 222/82 |
| 3,684,124 | 8/1972 | Song | 220/270 |
| 3,696,957 | 10/1972 | Van Baarn | 215/321 |
| 4,095,713 | 6/1978 | Norton | 220/220 |
| 4,165,018 | 8/1979 | Giggard | 220/284 |
| 4,276,988 | 7/1981 | Kimm | 215/254 |
| 4,664,288 | 5/1987 | Pereira et al. | 220/270 |

*Primary Examiner*—Stephen Marcus
*Assistant Examiner*—Nova Stucker
*Attorney, Agent, or Firm*—Dowell & Dowell

[57] ABSTRACT

A safety cap which functions as a protective and sanitary seal for covering valves or quick disconnect coupling plugs of the type which are used on beverage tank dispensers and which may only be removed by destruction of the cap so as to provide a positive indication of tampering wherein the cap includes an upper body portion which is securely engagable over the valve and completely covers it and a lower skirt portion which is attached thereto by both an integral tear strip and a plurality of spaced frangible connecting elements so that removal of the cap requires a destruction of the frangible elements and a subsequent severing of the tear strip.

8 Claims, 3 Drawing Figures

TAMPER INDICATING CAP SEAL FOR CONTAINER VALVES

BACKGROUND OF THE INVENTION

1. Field of the Invention

This invention is generally related to caps, covers or seals for protecting dispensing valves or quick disconnect plugs and particularly to safety caps which are used as protective seals to cover such valves or plugs on beverage dispensing tanks and which caps can only be removed therefrom by destruction of such caps. Therefore, any attempt to obtain access to, or tamper with, a valve plug or contents of a container by removal of the cap will result in at least a partial destruction of the cap thereby providing a positive indication of tampering.

2. History of the Prior Art

In the distribution of various containerized products, it is important to insure that the product has not been tampered with prior to the time it reaches the ultimate consumer or user. Numerous types of protective caps and seals have been designed to cooperatively close a variety of containers and/or concurrently provide the consumer with a visible sign or indication that the product within the container has not been tampered with. Generally, such caps are referred to as destructible closure seals.

It is not only necessary to provide tamper indicating seals for product containers to insure that the consumer receives the proper quantity of product for which value has been paid but, more importantly, for health and safety considerations. Specifically, it is important that purchasers or ultimate consumers have positive assurances that the contents of containers have not been tampered with by anyone and that the contents of such containers remain in the same condition as when originally packaged.

The foregoing considerations extend to consumers using a wide variety of product receptacles including bottles, jars, canisters, aerosol dispensers, bulk dispensing cans and kegs and the like. Therefore, tamper indicating seals and closures must be designed to meet a variety of specific requirements for each situation.

Some examples of destructible seals and closures include: U.S. Pat. No. 2,643,015 to Soffer which discloses a completely covering cap with a tear strip and cover engaging teeth; U.S. Pat. No. 2,760,670 to Parish, Jr. directed to a destructible closure for wide mouth containers such as bottles and jars; U.S. Pat. No. 3,102,658 to Rosen disclosing a cap with a tear strip having internal grooves along the borders; U.S. Pat. No. 3,162,329 to Gregory which discloses a cap in which the skirt portion is held by a series of peripheral portions 26 which are broken for separation of the skirt portion; U.S. Pat. No. 3,474,930 to Lerner directed to tamper-proof lids for aerosol containers; U.S. Pat. No. 3,592,351 to Johnson, Jr. which shows a closure for the plug holes in pressurized bulk dispensing containers such as beer kegs; U.S. Pat. No. 3,684,124 to Song which discloses a cover having a tear strip with a tab and a series of internal dents for engaging beneath the rim of the can; U.S. Pat. No. 4,095,713 to Norton which discloses a tamper resistant cap for covering quick disconnect coupling plugs for containers of liquids and particularly soft drink syrups; U.S. Pat. No. 4,165,018 to Giggard disclosing a series of internal dents beneath the top of a cap for engaging the rolled over edge of a can cap; and U.S. Pat. No. 4,276,988 to Kimm et al which discloses a tamper-proof cap for containers having screw threaded spouts.

The foregoing prior art patent to Norton was designed to serve as a tamper indicating cap for use in the same environment or for use on the same type of containers as the cap seal of the present invention. In the distribution of bulk soft drink syrup containers, a protective cap such as that disclosed in Norton is used to provide a cover for the quick disconnect dispensing valve which is mounted to the upper end wall of the syrup container. As the valves of such containers extend outwardly with respect to the container, the caps must be designed to extend from the upper or outer portions thereof to a point adjacent the container end wall.

Problems are present with regard to use of caps of the Norton type. First, such caps do not provide maximum protection against dust and dirt contamination of the container valve as there are openings in such caps adjacent the valve seal which are formed in the upper portion of the valve body. Also, such caps are formed of a brittle plastic material which may break into separate pieces when being removed. The splintering of the cap creates a safety hazard by causing a risk of eye injury. Further, such caps are relatively complicated to mold thereby unnecessarily increasing manufacturing costs.

SUMMARY OF THE INVENTION

This invention is directed to a safety protective cap for use in covering valves or connection plugs of the type used in various conventional beverage tank type dispensers and which cap cannot be removed from engagement with the valve or plug without destroying the cap. The cap, which functions as a seal, is formed of a medium to high density polyethylene or similar material and includes a body portion having internal projections which lock the cap to the valve. A skirt portion extends outwardly with respect to the body and is connected thereto by a plurality of frangible connecting elements and an integrally formed tear strip which extends along weakened lines formed in the body of the cap. A pull tab extends outwardly from the skirt portion and provides a gripping surface by which pressure may be applied to pull the skirt portion outwardly with respect to the body portion thereby causing the destruction of the frangible connecting elements and a subsequent severing of the tear strip along a portion of the body of the cap to thereby release the cap from engagement with the dispensing valve or plug.

It is a primary object of the present invention to provide a protective cap for use in covering valves or quick connect or disconnect plugs of the type used with beverage dispensing containers which will at least be partially destroyed by any attempt to remove or bypass the cap to gain access to the valve or contents of the container and thereby provide a positive indication of unauthorized tampering or use of the container.

It is another object of the present invention to provide a tamperproof cap for use in covering valves or connector plugs used with beverage dispensing containers which not only provides a positive indication of unauthorized use or tampering but also provides a protective cover for the valve or plugs which will prevent contamination of the valve by dirt and other foreign particles.

It is yet another object of the present invention to provide a destructible safety cap for use in protecting valves or connection plugs used with various beverage tanks or containers wherein the cap is removable as a single piece by applying a pulling force on the tab of the cap and thereby lifting the cap from its seated engagement with the valve or plug.

It is also an object of the present invention to provide a tamperproof cap for use in covering valves or connector plugs used with beverage dispensing containers which is safer than prior caps used for the same purpose in that the cap does not fracture or break into separate pieces when being removed but stays or remains integrally connected as a single piece when removed.

Another object of the present invention is that the cap seal of the present invention cannot be removed or dislodged from engagement with a valve or connector plug by prying or urging the cap upwardly with respect to the valve or plug without causing visible indications of tampering.

DESCRIPTION OF THE PREFERRED EMBODIMENT

Figure 1:
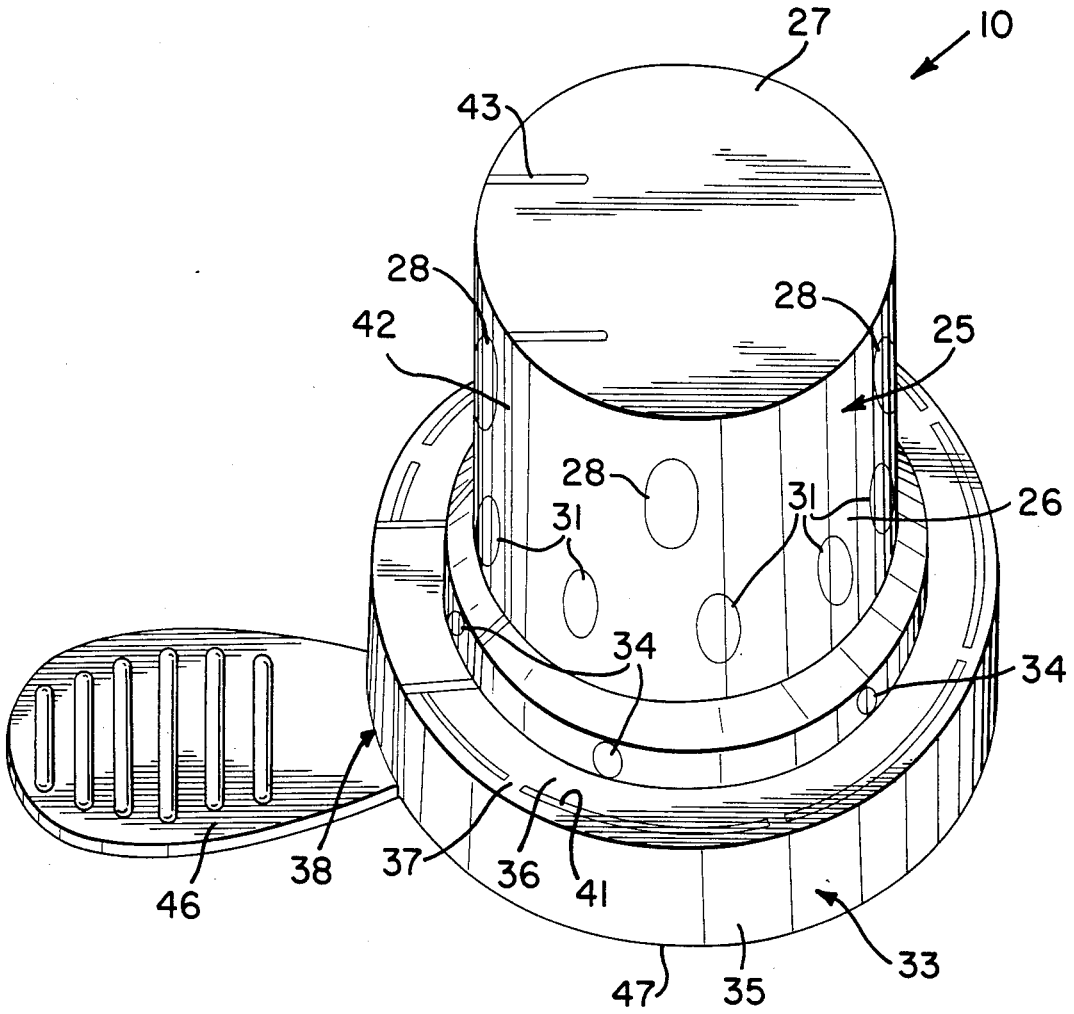
FIG. 1 is a perspective view of the cap of the present invention.
Figure 2:
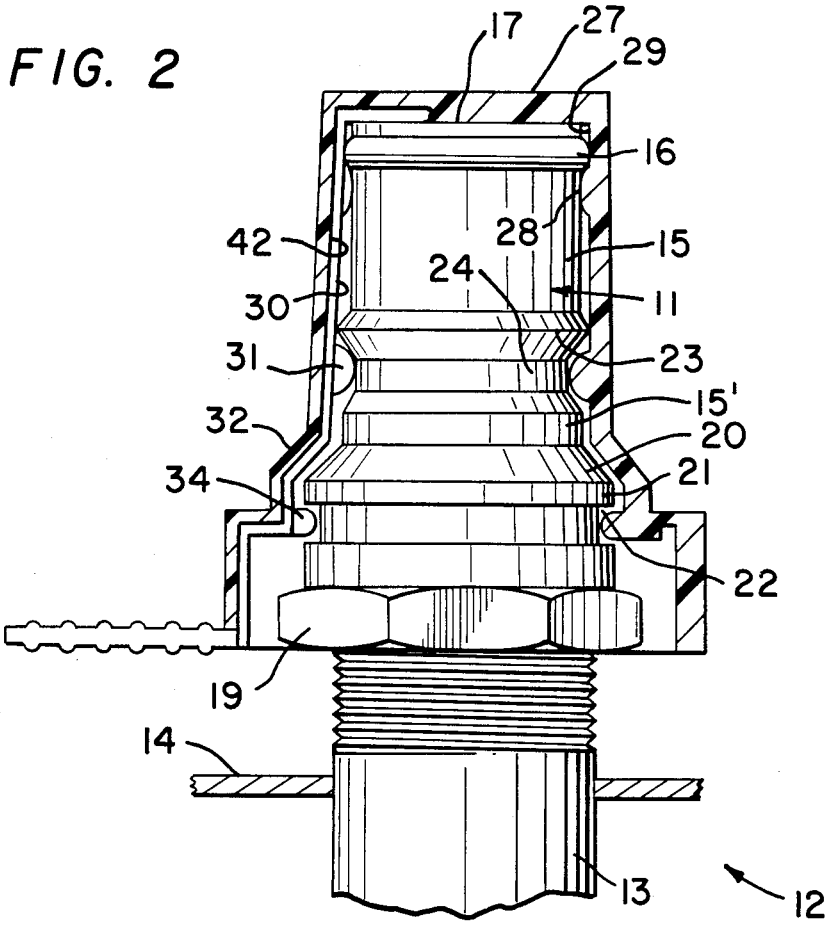
FIG. 2 is a view, partly in section, illustrating the cap of the present invention mounted on a conventional beverage dispensing quick disconnect plug or valve, the section being taken through the groove along one side of the pull tab and across the cap.

With continued reference to the drawings, the safety cap 10 of the present invention is shown as covering a conventional dispensing valve or plug 11 which is used in conjunction with a beverage dispensing tank generally indicated at 12. The tank may be generally cylindrical and of the type utilized to hold such fluids as soft drink syrups.

The plug 11 includes a base portion 13 which is secured to an end wall 14 of the tank. The plug has a generally cylindrical housing wall 15 in which a spring loaded valve member (not shown) is mounted. An annular O-ring 16 is seated in a groove spaced inwardly from the end or top 17 of the plug. At its lower end the plug has an integrally formed nut 19 with wrench engaging surfaces or facets. Just above the facets a bevelled annular lip 20 provides a ledge 21 for groove 22. Just above the beveled portion 20 a segment 15' of greater diameter than wall 15 is spaced from enlargement 23 by groove 24.

The safety cap 10 is utilized primarily as a tamper indication device when mounted in engagement with the plug 11. The cap, however, also functions as a cover for preventing dirt and other particles from contaminating the upper end or coupling portion 15 of the plug.

The cap includes a body portion 25 having a generally cylindrical side wall 26 and an end wall 27. The inner surface of the body portion is molded with a plurality of separate spaced protuberances or teeth 28 with curved or inclined side walls formed therein at a plane spaced from the end wall 27. In one embodiment the cap is formed of a translucent plastic and, hence, the internal protuberances are visible in FIG. 1. The teeth 28 taper and extend inwardly with respect to the axis of the cylindrical side walls of the body and engage the wall 15 of the plug just beneath the O-ring. The inner surface of the cap therefore includes an upper annular portion 29 which is of a diameter to cooperatively and tightly engage and secure the cap to the coupling portion 21 of the plug. The lower annular portion 30 of the inner surface of the body portion 25 tapers to a somewhat greater diameter to receive the ledge 21 of the plug and has a plurality of teeth 31, also with curved or inclined side walls, which are received in the groove 24 when the cap is placed over the plug.

Beneath the generally cylindrical side wall 26 the cap tapers outwardly at rim 32 to skirt portion 33. The inner surface of the rim 32 is molded with a plurality of teeth 34 which extend inwardly in the groove 22 beneath the ledge 21 when the cap is engaged with the plug.

The skirt portion 34 is included to provide a positive indication that the cap of the present invention has not been removed or tampered with in an attempt to gain access to the contents of the container. The skirt portion 33 has an annular depending wall 35 which extends over the nut 19 of the plug. The upper end of the skirt 33 includes an annular flange 36 which is integrally joined to the wall 35 by a plurality of thinly formed and generally equally spaced connecting members or elements 37 and a wider tear strip member 38. A plurality of open areas 41 are provided between the elements 37. The connecting elements are molded between the body and skirt portions of the cap in such a manner as to be easily severed from at least one of such portions upon the relative displacement of such portions with respect to one another.

Due to the configuration of the body of the cap, the cap will be forced outwardly or will yield outwardly as it is urged into engagement with the coupling portion of the side wall thereby permitting the plug to pass beyond the lower annular portion 30 and flange 28. Thereafter the plug will be seated within the upper annular portion 29 of the cap. The O-ring seated within the plug will be compressed during the initial placement of the cap over the plug. The flange 28 will abut the lower surface of the O-ring and thereby prevent withdrawal of the plug from within the cap.

The tear strip is molded with the cap, being connected along the height of the sidewall and also along a portion of the end wall by a pair of spaced and parallel weakened lines or grooves 42, 43 which are formed on the internal wall of the cap, the exterior wall being smooth. These grooves provide vents for the escape of air, to avoid the trapping of air in the end of the cap by the O-ring when the cap is rapidly pushed onto the plug.

The tear strip has a pull tab 46 integrally molded with it which extends outwardly from the lowermost edge 47 of the skirt portion.

Figure 3:
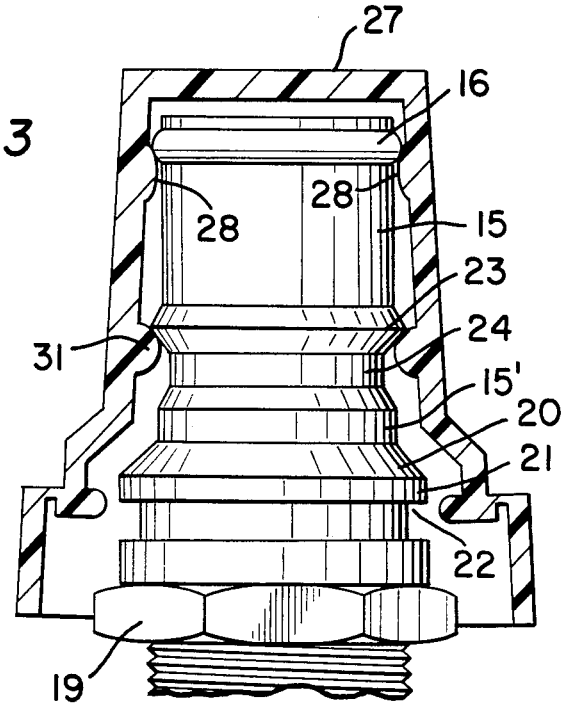
FIG. 3 is a cross-section of the cap, taken from the front illustrating the removal of the cap by spreading its sides outwardly when the tear strip is torn from the sides and lifted upwardly.

Once the cap of the present invention has been placed over the plug or valve of a container or tank, the body portion thereof is locked in engagement therewith. As previously discussed, the cap forms a seal which can only be removed from the plug or valve by at least the partial destruction thereof. To remove the cap, referring to FIG. 3, the tab 46 is grasped and pulled outwardly and upwardly with respect to the body portion of the cap. This causes the tab to peel upwardly, along the lines 42, 43 and across a portion of the wall 27 thereby severing the wall and permitting its remaining portion to expand, thus freeing the teeth 34, 31, and 28 from restrictive engagement with the grooves 22, and 24, and O-ring 16. The upward axial lifting force on the tab causes the O-ring and tapering sides of the groove 24 to cam the curved or inclined sides of the teeth 28 and 31 outwardly therefore spreading the side walls of the cap and permitting the teeth 34 at the lower rim of the cap to move outwardly out of engagement with the ledge 21 of the plug, thus freeing the cap from locked engagement with the plug. This permits removal of the cap in one piece in one easy motion.

As previously discussed, the cap of the invention provides a positive indication if someone has or has attempted to gain access to the contents of the container through the plug or valve. Because of the frangible connecting elements 37, any attempt to pry the cap from the valve or plug will result in one or more of the connecting members being severed along the weakened joints or lines.

The cap 10 of the present invention is specifically designed to insure that it may be safely removed in a single piece from the plugs or valves to which they are mounted. Prior caps have been brittle and tended to fly apart into many pieces when being removed and therefore were potentially hazardous.

The cap 10 is preferrably formed of a pliable plastic material which may be selected from medium and high density polyethylenes and other non-cyrstaline plastic resins. The cross section thickness of any portion of the cap generally will be between 0.020 to 0.030 inches when molded, except along the weakened areas discussed above.

I claim:

1. A cap seal for use in covering and preventing undetected removal of a valve plug having a generally cylindrical wall on a container, the valve plug having an end face, an O-ring just below the end face extending radially beyond the contiguous surface of the plug, and a base portion with wrench engageable surfaces extending radially beyond the contiguous surface of the plug, comprising a body having a generally cylindrical side wall, a closed end wall and an open end, said body being of a size approximately to engage the O-ring, said body having protrusion means adjacent to its end wall and, when the seal is mounted on the plug, extending inwardly beneath the O-ring and proximate to said plug wall, a skirt portion depending from said body and being joined thereto by frangible connecting means and having a wall portion with an integrally formed tear strip which is separable from said skirt portion along spaced frangible lines, said wall portion being substantially parallel to said side wall and overlying a least a portion of said wrench engageable surfaces, said tear strip extending along the height of the side wall and the skirt portion and being separable from said side wall along spaced frangible lines which extend along said side wall and formed by internal grooves therein, said grooves permitting air to escape from inside the cap and past the O-ring when it is applied to a plug, and pull tab means extending from said tear strip, whereby said tear strip may be severed along said frangible lines in order to remove said cap from the valve plug, and whereby undetected removal and replacement of said cap seal or manipulation of said wrench engageable surfaces is prevented.

2. The invention of claim 1, said plug having means intermediate the O-ring and the wrench engageable surfaces extending radially beyond the contiguous surface of the plug, and having an annular groove therebeneath, said body having second protrusion means intermediate its ends, and when the seal is mounted on the plug, extending into said annular groove, whereby when the tear strip is severed and lifting force applied the protrusion means adjacent to the end wall engages the O-ring and cams the remaining portions of the side wall outwardly to free the second protrusion means from engagement with the annular groove.

3. The invention of claim 1, said plug having means intermediate the O-ring and the wrench engageable surfaces extending radially outwardly beyond the contiguous surface of the plug and having an inclined surface therebeneath, said body having second protrusion means intermediate its open ends, and when the seal is mounted on the plug, extending beneath said inclined surface, and said plug having ledge means adjacent to and above its wrench engageable surfaces and extending radially beyond the contiguous surface of the plug, said body having third protrusion means adjacent to its open end, and when the seal is mounted on the plug, extending beneath said ledge means to prevent removal of said cap, whereby, when the tear strip is severed and lifting force applied the protrusion means adjacent to the end wall and the second protrusion means engage, respectively, the O-ring and the intermediate radially outwardly extending means and cam the side wall from the open end of the body of the cap seal outwardly to free the third protrusion means from its engagement beneath said ledge means.

4. The cap seal of claim 1 in which the side wall of said body is tapered inwardly along its length from its skirt portion to its closed end wall.

5. The cap seal of claim 1 in which said body, said skirt portion and said frangible connecting means of the cap are formed of a flexible non-shattering plastic material.

6. The invention of claim 1, in which the protrusion means are circumferentially spaced individual protrusions.

7. The invention of claim 2, in which the second protrusion means are circumferentially spaced individual protrusions.

8. The invention of claim 3, in which each of the second and third protrusion means are circumferentially spaced individual protrusions.

* * * * *